US008262398B2

(12) United States Patent
Chen

(10) Patent No.: US 8,262,398 B2
(45) Date of Patent: Sep. 11, 2012

(54) COAXIAL ELECTRICAL CONNECTOR

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 70 days.

(21) Appl. No.: 12/785,509

(22) Filed: May 24, 2010

(65) Prior Publication Data

US 2010/0297876 A1 Nov. 25, 2010

(30) Foreign Application Priority Data

May 22, 2009 (CN) ..... 2009 2 030487

(51) Int. Cl.
*H01R 29/00* (2006.01)

(52) U.S. Cl. ..... 439/188; 439/63; 439/944; 439/736

(58) Field of Classification Search ..... 439/63, 439/188, 944, 736
See application file for complete search history.

(56) References Cited

U.S. PATENT DOCUMENTS

| | | | | |
|---|---|---|---|---|
| 6,464,546 | B2 * | 10/2002 | LaCoy | 439/847 |
| 6,474,995 | B1 * | 11/2002 | Wu | 439/63 |
| 6,902,408 | B2 * | 6/2005 | Yamane | 439/63 |
| 7,651,334 | B2 * | 1/2010 | Zhang | 439/63 |
| 2010/0093234 | A1 * | 4/2010 | Lang et al. | 439/884 |

* cited by examiner

*Primary Examiner* — Truc Nguyen
(74) *Attorney, Agent, or Firm* — Wei Te Chung; Andrew C. Cheng; Ming Chieh Chang

(57) ABSTRACT

A coaxial connector includes an outer conductor having a tubular section and leg sections. A central conductor having a mating portion extends in an axial direction within the tubular section, and the mating portion is centrosymmetrical about a central axis thereof. A dielectric block holds said outer and central conductors. The mating portion has a contacting portion, a transitional portion and a guiding portion, the transitional portion joins the contacting portion and the guiding portion together, the transitional portion is larger than the guiding portion and smaller than the mating portion at diameters thereof; wherein an acute angle formed by the transitional portion and the central axis is larger than an acute angle formed by the guiding portion and the central axis.

6 Claims, 4 Drawing Sheets

COAXIAL ELECTRICAL CONNECTOR

BACKGROUND OF THE INVENTION

1. Field of the Invention

The present invention relates to the art of electrical connectors, and more particularly to a coaxial electrical connector for being connected to a printed circuit board.

2. Description of the Related Art

Impedance match issue is one of the most important things for signal transmission of electrical connectors. Different kinds of ways are adopted by designers to adjust the impedance of contacts to a proper value. In order to adjust the impedance of contacts to a proper value, designers usually adopt the way of changing the dielectric constant around the contacts. As disclosed in U.S. Pat. No. 6,902,408, a coaxial electrical connector includes an outer conductor having a tubular section. A central conductor has a mating portion that extends in an axial direction within the tubular section, the mating portion is a circular column having a cambered top. A dielectric block is molded so as to hold together the outer and central conductors together as one unit, and a radial section extends outwardly from a bottom of the contact section. However, during the mating process of the coaxial electrical connector and a complementary connector, the mating portion of the coaxial electrical connector can not be inserted into a space defined by the contact pieces of the complementary connector sometimes. Because the contact pieces of the complementary connector are not guided by the mating portion of the coaxial electrical connector well.

Therefore, there is a need to provide a coaxial electrical connector to resolve the above-mentioned problem.

SUMMARY OF THE INVENTION

A coaxial connector includes an outer conductor having a tubular section and leg sections. A central conductor having a mating portion extends in an axial direction within the tubular section, and the mating portion is centrosymmetrical about a central axis thereof. A dielectric block holds said outer and central conductors. The mating portion has a contacting portion, a transitional portion and a guiding portion, the transitional portion joins the contacting portion and the guiding portion together, the transitional portion is larger than the guiding portion and smaller than the mating portion at diameters thereof; wherein an acute angle formed by the transitional portion and the central axis is larger than an acute angle formed by the guiding portion and the central axis.

Other features and advantages of the present invention will become more apparent to those skilled in the art upon examination of the following drawings and detailed description of preferred embodiments, in which:

DETAILED DESCRIPTION OF PREFERRED EMBODIMENT

Referring to FIGS. 1 to 4, a coaxial electrical connector 1 according to an embodiment of the present invention is shown to include an outer conductor 10, a central conductor 20 and a dielectric block 30 that integrally holds the outer conductor 10 and the central conductor 20 as a unit. The coaxial electrical connector 1 is to be electrically connected onto a printed circuit board (not shown).

Figure 3:
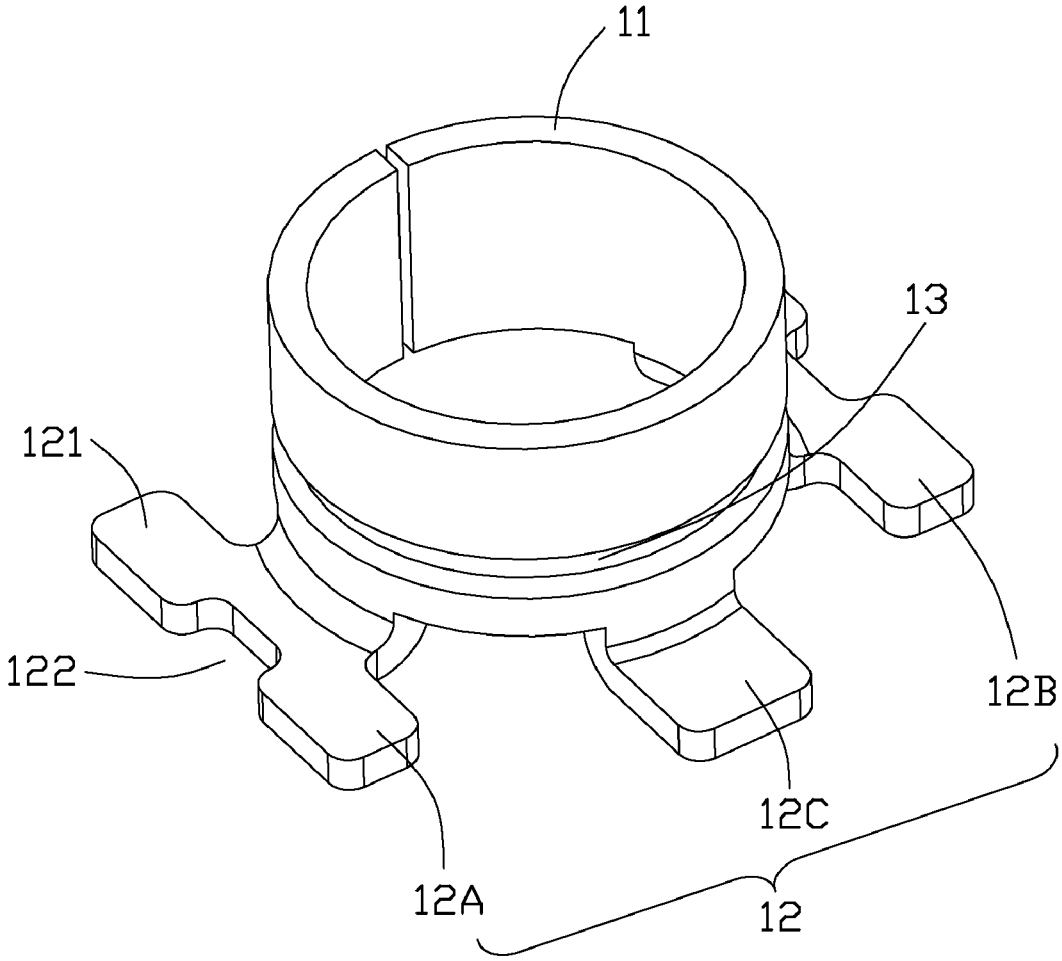
FIG. 3 is a perspective view of an outer conductor of the coaxial electrical connector of FIG. 1.
Figure 4:
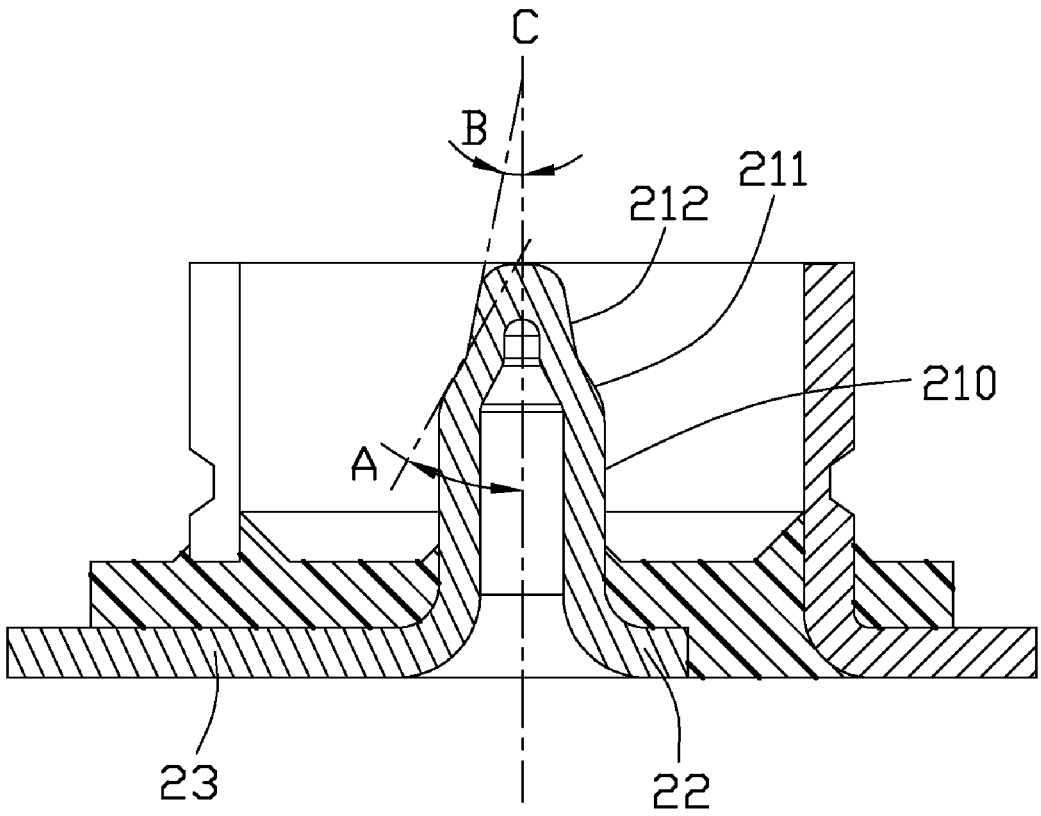
FIG. 4 is a cross-sectional view of the coaxial electrical connector taken along line 4-4 of FIG. 1.

Referring to FIG. 3, the outer conductor 10 is made by bending and forming a metal sheet so as to provide a tubular section 11 with an axial line which is the inserted direction of a complementary connector (not shown) and three leg sections 12 extending outwardly from a bottom edge of the tubular section 11. The tubular section 11 is provided with an engaging groove 13 along the middle periphery thereof for engaging with the outer conductor of the complementary connector for preventing separation. Two of said leg sections 12A and 12B, which are diametrically opposed to each other, are made relatively wide and another leg section 12C is narrower than these two leg sections 12A, 12B, the leg sections 12A and 12B are flush with a bottom face of the connector so that when the connector is placed on the printed circuit board, they are soldered with circuit traces (not shown) of the printed circuit board. Therefore, the leg sections 12A and 12B have curved borders so as to have a stronger solder connection with the circuit traces of the printed circuit board due to having a longer outer line of the curved border as opposed to the linear-type border of the conventional leg section. Each of the leg sections 12A and 12B is designed to have two solder wings 121 with a notch 122 therebetween. Moreover, the arrangement of the notches 122 between the two solder wings 121 also enables the additional solder material to be gathered within the notches 122 so as to prevent overflowing during the soldering process, of the additional solder material out of the region of leg sections.

Figure 1:
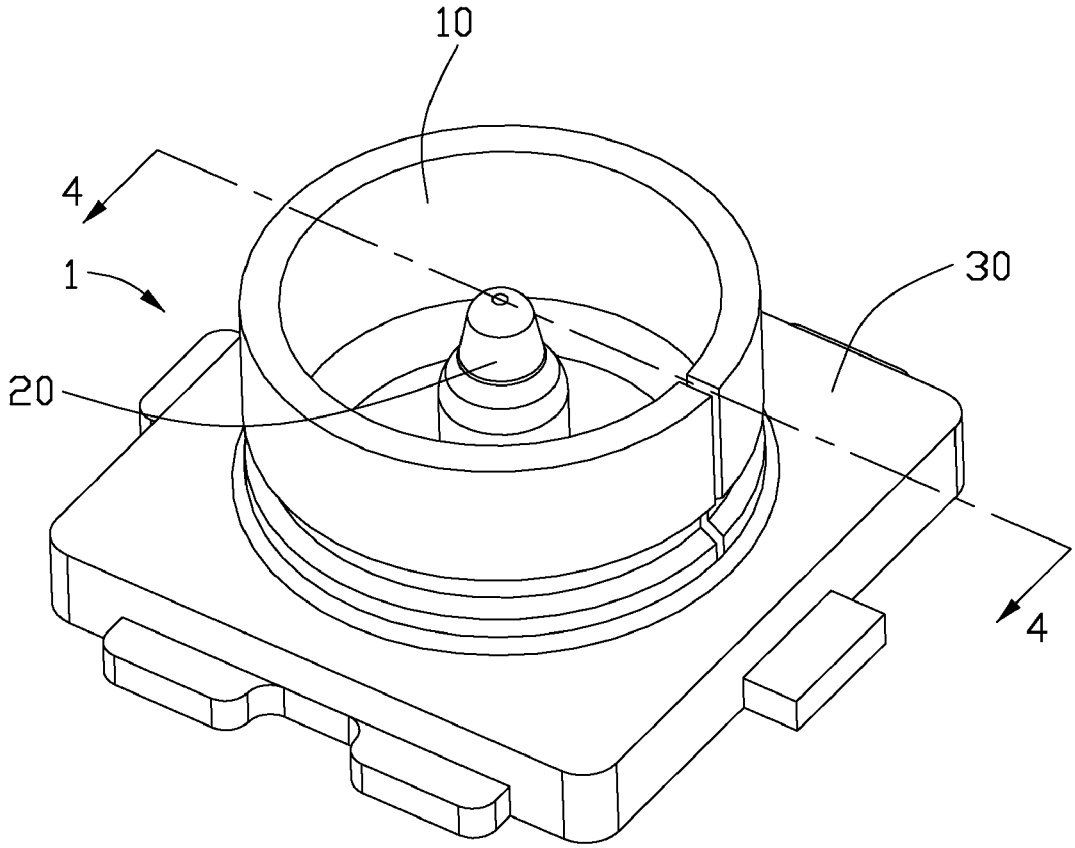
FIG. 1 is an assembled, perspective view of a coaxial electrical connector according to an embodiment of the present invention.
Figure 2:
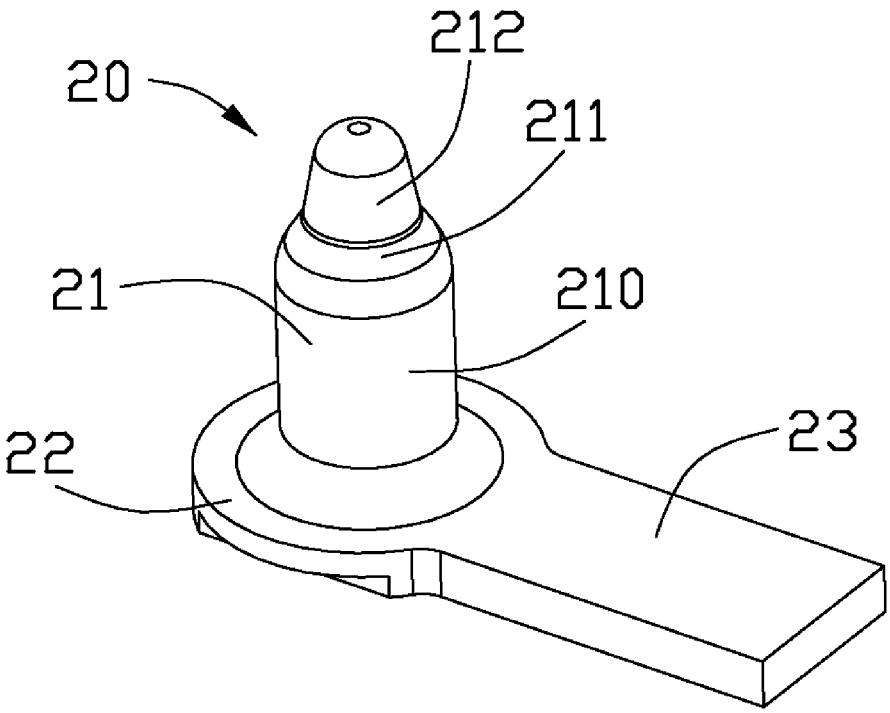
FIG. 2 is a perspective view of a central conductor of the coaxial electrical connector of FIG. 1.

As shown in FIG. 2, the central conductor 20 is made by bending and forming a metal sheet so as to provide a mating portion 21 that extends in an axial as arrow C within the tubular section 11, and a radial section 22 extending outwardly in a radial direction from a bottom of the mating portion 21. An extension section 23 extends in one radial direction from the radial section 22 as shown in the cross-section view of FIG. 4. The mating portion 21 is made by deep-drawing pressing a metal sheet so as to provide a hollow form which has a semi-spherical tip and flared bottom that leads to the radial section 22. The mating portion 21 is centrosymmetrical about the axis C. The lower face of the radial section 22 is adapted to be in contact with the printed circuit board. The mating portion 21 comprises a contacting portion 210, a transitional portion 211 and a guiding portion 212 from bottom to top. The contacting portion 210 extends upwardly from the radial section 22 and is shaped as a circular column. The transitional portion 211 joins the contacting portion 210 and the guiding portion 212 together. The diameters of the guiding portion 212 and the transitional portion 211 along the radial direction become narrower gradually from bottom to top. It means that the largest diameter of the guiding portion 212 is equal to the shortest diameter of the transitional portion 211. Please refers to FIG. 4, it should be noted that the acute angle A defined by the axis C and the tangent line of the transitional portion's outer face is bigger than the acute angle B defined by the axis C and the tangent line of the guiding portion's outer face. The tip of the central conductor 20 of this preferred embodiment does not exceed the top of the outer conductor 10. However, in an alternative embodiment, the tip of the central conductor 20 may be located beyond the top of the outer conductor 10 depending on different applications of a coaxial electrical connector. In this preferred embodiment, the ideal height ratio of the guiding portion 212, the transitional portion 211 and the contacting portion 210 is 3:2:5.

During the mating process, the guiding portion 212 is received in a space defined by contact pieces of the complementary connector firstly and leads the complementary connector moving downwardly. Then, the contact pieces contacts with the transitional portion 211 and are stretched gradually as moving downwardly. At last, the contact pieces of the complementary connector hold the contacting portion 210 elastically, the complementary connector completely mates with the coaxial electrical connector 1. As compared with the prior art, the guiding portion 212 and the transitional portion 211 prevent the complementary connector from misleading during assembly process.

While the present invention has been described with reference to preferred embodiments, the description of the invention is illustrative and is not to be construed as limiting the invention. Various modifications to the present invention can be made to preferred embodiments by those skilled in the art without departing from the true spirit and scope of the invention as defined by the appended claims.

What is claimed is:

1. A coaxial electrical connector comprising:

a planar insulative housing;

an outer conductor surrounding the housing and defining a plurality of soldering legs extending outwardly from a bottom edge of the outer shell at different radial positions;

a mating cavity defined within the outer conductor and above the housing; and a one-piece inner conductor located at a center of the housing, said inner conductor including a mating portion upstanding in the mating cavity and an extension section linked by a radial section which extends from a circumference of a bottom edge of the mating portion in a radial direction; wherein the mating portion extending in an axial direction perpendicular to said radial direction, defines a vertical tubular lower contact portion with a maximum diameter thereof, a conical middle transitional portion linked to the vertical tubular lower contact portion and being upwardly gradually shrunk with a medium average diameter thereof, and a conical upper guiding portion linked to the conical middle transitional portion and being upwardly gradually and smoothly inwardly shrunk with a minimum average diameter thereof; wherein the mating portion is made by deeply drawing.

2. A coaxial electrical connector comprising:

a planar insulative housing;

an outer conductor surrounding the housing and defining a plurality of soldering legs extending outwardly from a bottom edge of the outer shell at different radial positions;

a mating cavity defined within the outer conductor and above the housing; and a one-piece inner conductor located at a center of the housing, said inner conductor including a mating portion upstanding in the mating cavity and an extension section linked by a radial section which extends from a circumference of a bottom edge of the mating portion in a radial direction; wherein the mating portion extending in an axial direction perpendicular to said radial direction, defines a vertical tubular lower contact portion with a maximum diameter thereof, a conical middle transitional portion linked to the lower contact portion and being upwardly gradually and smoothly inwardly shrunk with a medium average diameter thereof, and an upper guiding portion linked to the middle transitional portion and being upwardly gradually and smoothly inwardly shrunk with a minimum average diameter thereof; wherein the lower contact portion is located in a lower half of said mating cavity in said axial direction, and both the middle transitional portion and said upper guiding portion are commonly located in an upper half of said mating cavity in said axial direction; wherein a sum of axial dimensions of said upper guiding portion and the middle transitional portion is not more than that of the lower contact portion.

3. The coaxial connector as claimed in claim 2, wherein said upper guiding portion is conical.

4. The coaxial connector as claimed in claim 3, wherein a tapered angle of the upper guiding portion with regarding to an axis of the mating portion is larger than that of the middle transitional portion.

5. The coaxial connector as claimed in claim 4, wherein a tip of the upper guiding portion is essentially flush with an upper edge of the outer conductor.

6. The coaxial connector as claimed in claim 2, wherein a maximum diameter of the upper guiding portion is not larger than a minimum diameter of the middle transitional portion, and a maximum diameter of the middle transitional portion is not larger than a minimum diameter of the lower contact portion.

* * * * *